US009946206B2

(12) United States Patent
Aoki

(10) Patent No.: US 9,946,206 B2
(45) Date of Patent: Apr. 17, 2018

(54) IMAGE DEFECT PREDICTIVE DIAGNOSTIC APPARATUS, IMAGE DEFECT PREDICTIVE DIAGNOSTIC SYSTEM, AND NON-TRANSITORY COMPUTER READABLE MEDIUM

(71) Applicant: FUJI XEROX CO., LTD., Tokyo (JP)

(72) Inventor: Matsuyuki Aoki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/012,998

(22) Filed: Feb. 2, 2016

(65) Prior Publication Data

US 2017/0060065 A1 Mar. 2, 2017

(30) Foreign Application Priority Data

Aug. 31, 2015 (JP) ..... 2015-170641

(51) Int. Cl.
*G03G 15/00* (2006.01)
*G03G 15/06* (2006.01)
*G03G 15/08* (2006.01)

(52) U.S. Cl.
CPC ..... *G03G 15/5062* (2013.01); *G03G 15/065* (2013.01); *G03G 15/0849* (2013.01); *G03G 15/5058* (2013.01); *G03G 15/55* (2013.01)

(58) Field of Classification Search
CPC ..... G06K 9/036; G06K 9/03; G06T 2207/30144; G03G 15/5062; G03G 15/065; G03G 15/0849; G03G 15/5058; G03G 15/55
See application file for complete search history.

(56) References Cited

U.S. PATENT DOCUMENTS

2005/0154562 A1 7/2005 Matsuura et al.
2005/0157327 A1 7/2005 Shoji et al.
2005/0240376 A1* 10/2005 Uwatoko ..... G03G 15/55 702/183
2007/0127934 A1 6/2007 Shoji et al.
2007/0237399 A1* 10/2007 Satonaga ..... G06K 9/4647 382/225
2008/0010522 A1* 1/2008 Uwatoko ..... G06N 7/005 714/23
2010/0123914 A1* 5/2010 Uwatoko ..... H04N 1/6094 358/1.9
2011/0091226 A1* 4/2011 Ishigaya ..... G03G 15/2064 399/33

FOREIGN PATENT DOCUMENTS

JP 4564798 B2 10/2010

* cited by examiner

*Primary Examiner* — David Banh
(74) *Attorney, Agent, or Firm* — Oliff PLC

(57) ABSTRACT

An image defect predictive diagnostic apparatus includes an acquisition unit and a notification unit. The acquisition unit acquires first characteristic values and second characteristic values from an image forming apparatus that forms an image by using an electrophotographic process. The first characteristic values include at least one of (i) toner concentrations and (ii) developing potentials. The first characteristic values have an influence on developability. The second characteristic values are different from the first characteristic values. The notification unit predicts occurrence of a dot image which has no relationship with the image by using the first characteristic values and the second characteristic values which are acquired by the acquisition unit, and that makes notification.

4 Claims, 9 Drawing Sheets

IMAGE DEFECT PREDICTIVE DIAGNOSTIC APPARATUS, IMAGE DEFECT PREDICTIVE DIAGNOSTIC SYSTEM, AND NON-TRANSITORY COMPUTER READABLE MEDIUM

CROSS-REFERENCE TO RELATED APPLICATIONS

This application is based on and claims priority under 35 USC 119 from Japanese Patent Application No. 2015-170641 filed Aug. 31, 2015.

BACKGROUND

Technical Field

The present invention relates to an image defect predictive diagnostic apparatus, an image defect predictive diagnostic system, and a non-transitory computer readable medium.

SUMMARY

According to an aspect of the invention, an image defect predictive diagnostic apparatus includes an acquisition unit and a notification unit. The acquisition unit acquires first characteristic values and second characteristic values from an image forming apparatus that forms an image by using an electrophotographic process. The first characteristic values include at least one of (i) toner concentrations and (ii) developing potentials. The first characteristic values have an influence on developability. The second characteristic values are different from the first characteristic values. The notification unit predicts occurrence of a dot image which has no relationship with the image by using the first characteristic values and the second characteristic values which are acquired by the acquisition unit, and that makes notification.

BRIEF DESCRIPTION OF THE DRAWINGS

Exemplary embodiments of the present invention will be described in detail based on the following figures, wherein.

DETAILED DESCRIPTION

Figure 1:
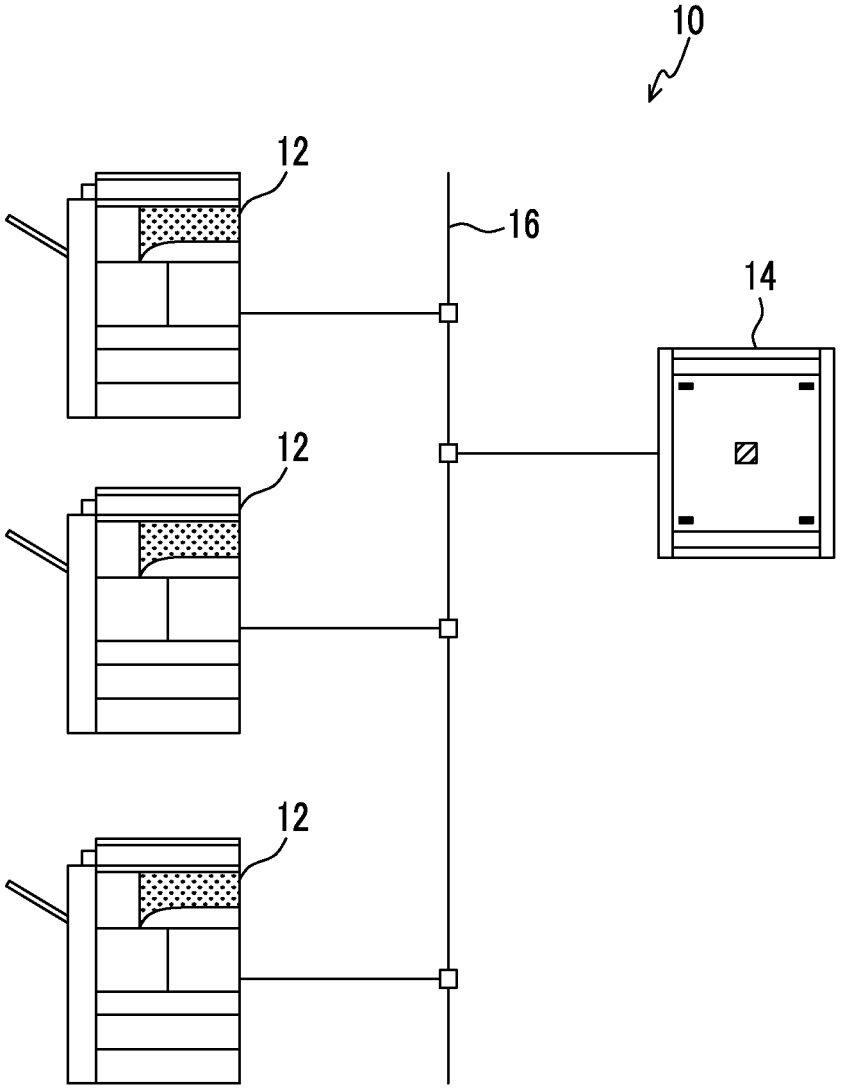
FIG. 1 is a diagram illustrating a schematic configuration of an image defect predictive diagnostic system including an image defect predictive diagnostic apparatus according to this exemplary embodiment.

Hereinafter, an exemplary embodiment will be described with reference to the accompanying drawings. FIG. 1 is a diagram illustrating a schematic configuration of an image defect predictive diagnostic system including an image defect predictive diagnostic apparatus according to this exemplary embodiment An image defect predictive diagnostic system 10 includes plural image forming apparatuses 12 and an image defect predictive diagnostic apparatus 14. Each of the plural image forming apparatuses 12 and the image defect predictive diagnostic apparatus 14 are connected to a communication network 16.

Each of the image forming apparatuses 12 includes a function of forming an image by using an electrophotographic process, and a function of monitoring an operation time, a use environment, and the like and transmitting a monitoring result to the image defect predictive diagnostic apparatus 14. The image defect predictive diagnostic apparatus 14 includes a function of receiving information of the operation time, the use environment, and the like, which is transmitted from each of the image forming apparatuses 12, and a function of predicting lifetime of a component based on an operation status of each of the image forming apparatuses 12.

Figure 2:
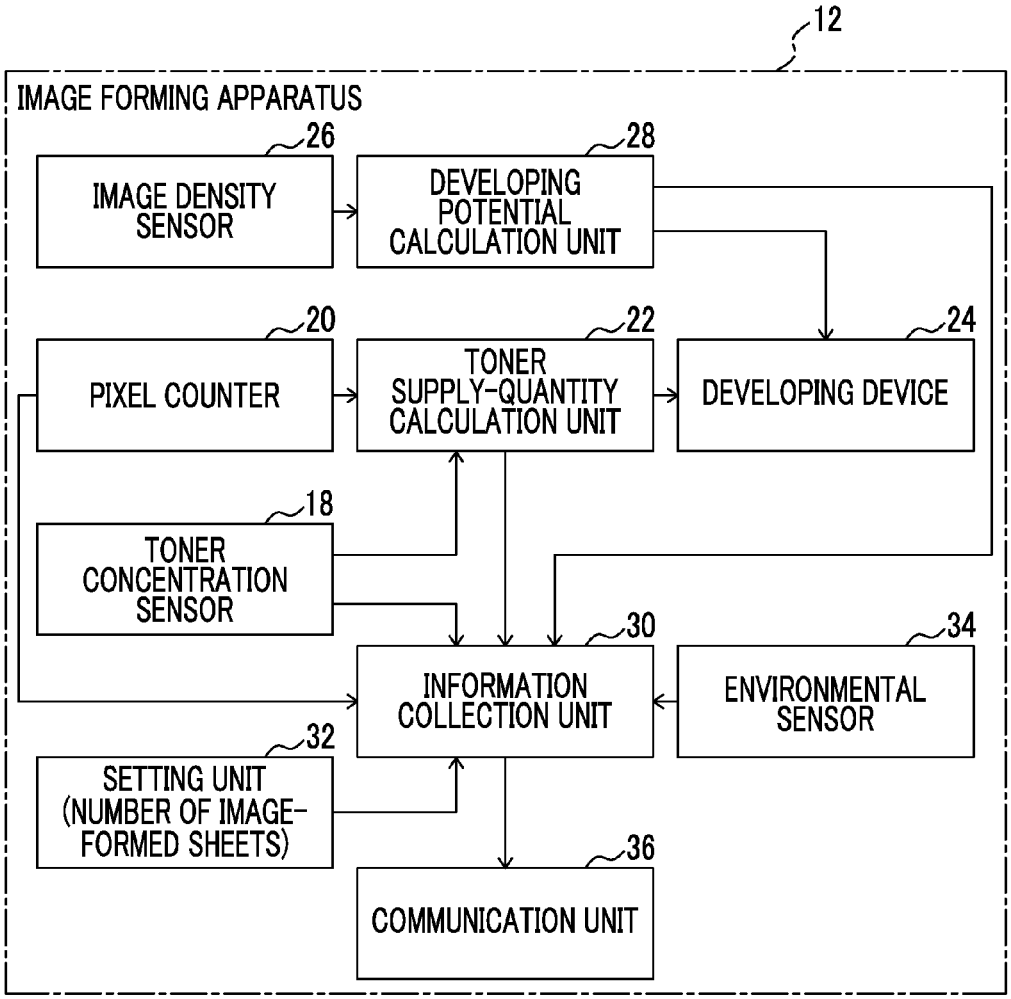
FIG. 2 is a block diagram illustrating a schematic configuration of an image forming apparatus in the image defect predictive diagnostic system according to this exemplary embodiment.

Here, each of the image forming apparatuses 12 and the image defect predictive diagnostic apparatus 14 will be described in detail. First, a configuration of the image forming apparatus 12 will be described. FIG. 2 is a block diagram illustrating a schematic configuration of the image forming apparatus 12 in the image defect predictive diagnostic system 10 according to this exemplary embodiment.

An example in which the image forming apparatus 12 is a tandem type will be described. That is, in the image forming apparatus 12, an image forming unit forms a toner image corresponding to each of colors of Y (yellow), M (magenta), C (cyan), and K (black). A toner image formed by the image forming unit is primarily transferred onto an intermediate transfer member, and then the transferred toner image is secondarily transferred onto paper. The fixing machine fixes the transferred image.

As illustrated in FIG. 2, the image forming apparatus 12 includes a toner concentration sensor 18, a pixel counter 20, a toner supply-quantity calculation unit 22, a developing device 24, an image density sensor 26, and a developing potential calculation unit 28.

The developing device 24 included in the image forming unit performs toner supply control. The toner supply control is performed as follows. A toner concentration sensor 18 detects toner concentration in the developing device. A pixel counter 20 counts the number of pixels (performs pixel count) corresponding to each color of image information of an image to be formed. The toner supply-quantity calculation unit 22 calculates a toner supply quantity based on a detection value of the toner concentration sensor 18, and a detection value of the pixel counter 20. The developing device 24 is controlled based on the calculated toner supply quantity, and thus the toner supply quantity is controlled.

In the image forming apparatus 12, a predetermined patch image is formed on an intermediate transfer member and density (reflectance) of the formed patch image is detected by using the image density sensor 26 that detects image density. The developing potential calculation unit 28 calculates a developing potential and the developing device 24 is controlled to apply the calculated developing potential. Thus, an image to be formed has required density. The developing potential indicates a difference between (i) a voltage (developing bias) applied to a developing roll in the developing device 24 and (ii) an exposure potential.

In the image forming apparatus 12, the image density sensor 26 detects density of the patch image having plural tones and control such as correction of the tones is also performed so as to cause the image to have a required tone curve. The image forming apparatus 12 may include, for example, a function of causing a reading unit (which reads an image) to read the patch image having the tones after fixation and correcting the tones.

The image forming apparatus 12 further includes an information collection unit 30, a setting unit 32, an environmental sensor 34, and a communication unit 36.

The image forming apparatus 12 monitors an operation status of the image forming apparatus 12 itself. The information collection unit 30 collects information regarding the operation status. The information collection unit 30 collects information regarding an operation status, a use environment, and the like of the image forming apparatus 12, and transmits the collected information to the image defect predictive diagnostic apparatus 14 through the communication unit 36. In order to collect information of the operation status, the use environment, and the like, the toner concentration sensor 18, the pixel counter 20, the developing potential calculation unit 28, the toner supply-quantity calculation unit 22, the setting unit 32, and the environmental sensor 34 are connected to the information collection unit 30.

As described above, the toner concentration sensor 18 detects the toner concentration in the developing device and a detection value of the toner concentration is collected by the information collection unit 30. The pixel counter 20 counts the number of pixels for each color in a page, and a pixel count value is collected by the information collection unit 30. The developing potential calculation unit 28 calculates a developing potential corresponding to the density detected by the image density sensor 26, and information of the calculated developing potential is collected by the information collection unit 30. The toner supply-quantity calculation unit 22 calculates a toner supply quantity based on the detection value of the toner concentration sensor 18 and the pixel count value of the pixel counter 20, and information regarding the calculated toner supply quantity is collected by the information collection unit 30. The setting unit 32 performs setting for the number of image-formed sheets and various settings, and information set by the setting unit 32 is collected by the information collection unit 30. The environmental sensor 34 detects, for example, information of the humidity and the temperature, and the detected environmental information is collected by the information collection unit 30.

The communication unit 36 regularly transmits information of the operation status, the use environment, and the like which are collected by the information collection unit 30, to the image defect predictive diagnostic apparatus 14 through the communication network 16. For example, the communication unit 36 transmits, to the image defect predictive diagnostic apparatus 14, the information which is collected by the information collection unit 30, regularly (one time to four times per day).

Figure 3:
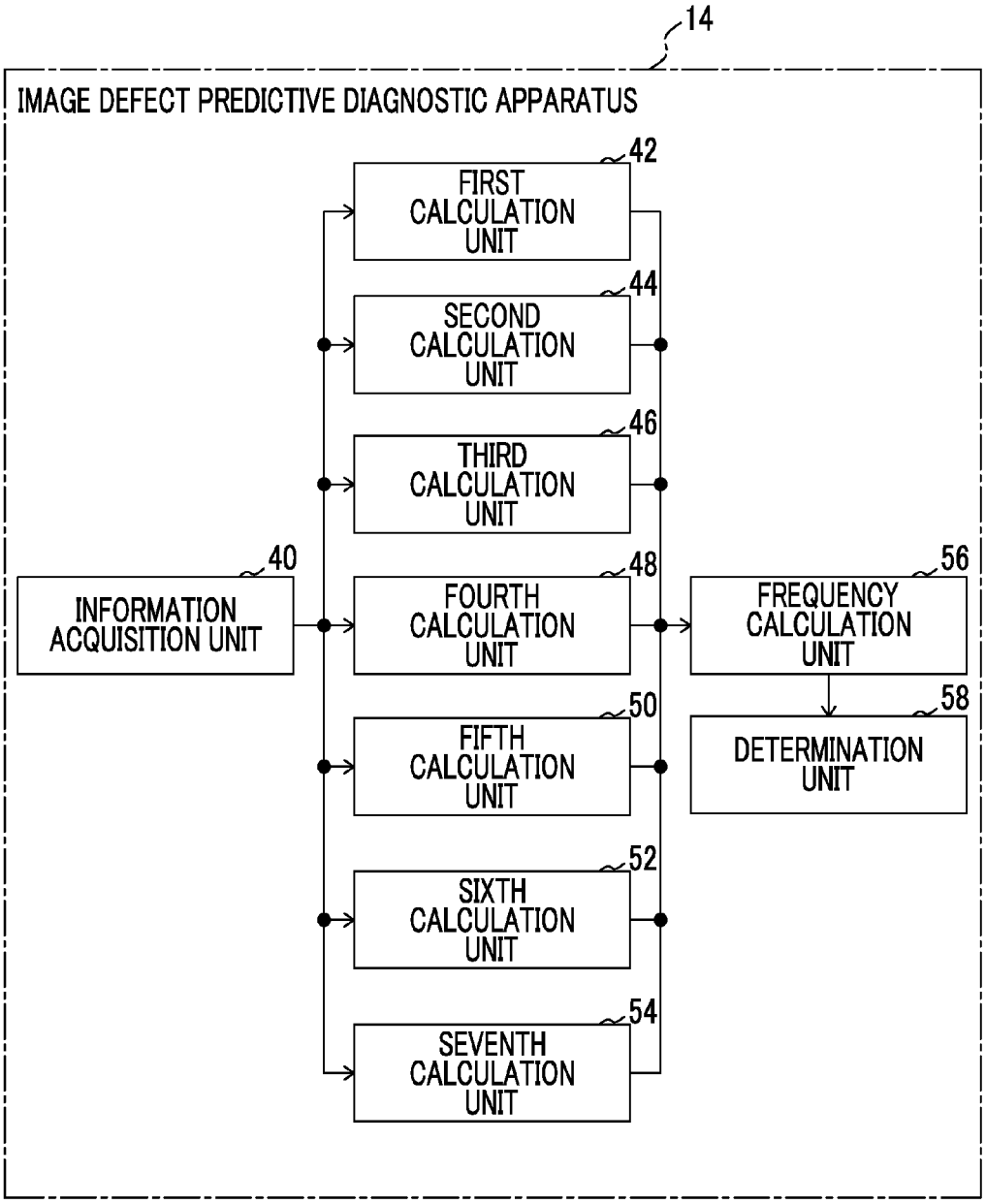
FIG. 3 is a block diagram illustrating a schematic configuration of the image defect predictive diagnostic apparatus in the image defect predictive diagnostic system according to this exemplary embodiment.

Next, a configuration of the image defect predictive diagnostic apparatus 14 will be described. FIG. 3 is a block diagram illustrating a schematic configuration of the image defect predictive diagnostic apparatus 14 in the image defect predictive diagnostic system 10 according to this exemplary embodiment.

As illustrated in FIG. 3, the image defect predictive diagnostic apparatus 14 includes an information acquisition unit 40, a first calculation unit 42, a second calculation unit 44, a third calculation unit 46, a fourth calculation unit 48, a fifth calculation unit 50, a sixth calculation unit 52, a seventh calculation unit 54, a frequency calculation unit 56, and a determination unit 58.

The information acquisition unit 40 acquires information collected by the information collection unit 30, through the communication network 16. That is, the information acquisition unit 40 acquires information of the operation status, the use environment, and the like which have been collected by the information collection unit 30 in each of the image forming apparatuses 12.

The first calculation unit 42 calculates an average of developing potentials collected by the information collection unit 30 in the image forming apparatus 12, that is, an average of setting values of developing potential which have been calculated and set in the developing device 24 by the developing potential calculation unit 28.

The second calculation unit 44 calculates an average of the toner concentrations collected by the information collection unit 30 of the image forming apparatus 12.

The third calculation unit 46 calculates an average of the humidities collected by the information collection unit 30 of the image forming apparatus 12.

The fourth calculation unit 48 calculates an average of pixel densities (so-called area coverage) based on pixel count values collected by the information collection unit 30 of the image forming apparatus 12.

The fifth calculation unit 50 calculates a variation in target value of toner concentration, based on information regarding the toner supply quantity, which has been collected by the information collection unit 30 of the image forming apparatus 12. Specifically, the fifth calculation unit 50 calculates a difference between a previous target value of the toner concentration and a current target value of the toner concentration when the current target value is obtained by changing the target value of the toner concentration in a direction of being increased.

The sixth calculation unit 52 calculates a detected humidity variation based on the information of the humidity, which has been collected by the information collection unit 30 of the image forming apparatus 12. Specifically, the sixth calculation unit 52 calculates a difference (variation) between a previous humidity and a current humidity changed in a direction in which the humidity is increased.

The seventh calculation unit 54 calculates a difference (a variation in average of detected pixel densities) between a previous average of the detected pixel density and a current average of the detected pixel density. The calculation of the seventh calculation unit 54 is performed based on the pixel count values collected by the information collection unit 30 of the image forming apparatus 12. Specifically, the seventh calculation unit 54 calculates a difference between the previous average of the pixel densities and the current average of the pixel densities when the current average is obtained by changing the average of the pixel density in a direction of being increased.

The frequency calculation unit 56 calculates frequencies of the respective values based on calculation results of the calculation units. The determination unit 58 determines a preliminary indicator of a dot image which is an image defect and which has no relationship with an image, based on a calculation result of the frequency calculation unit 56, and predicts occurrence of the dot image.

The above averages are calculated, for example, for every predetermined number of image-formed sheets, for every time information is collected, for each day, or the like.

Figure 4:
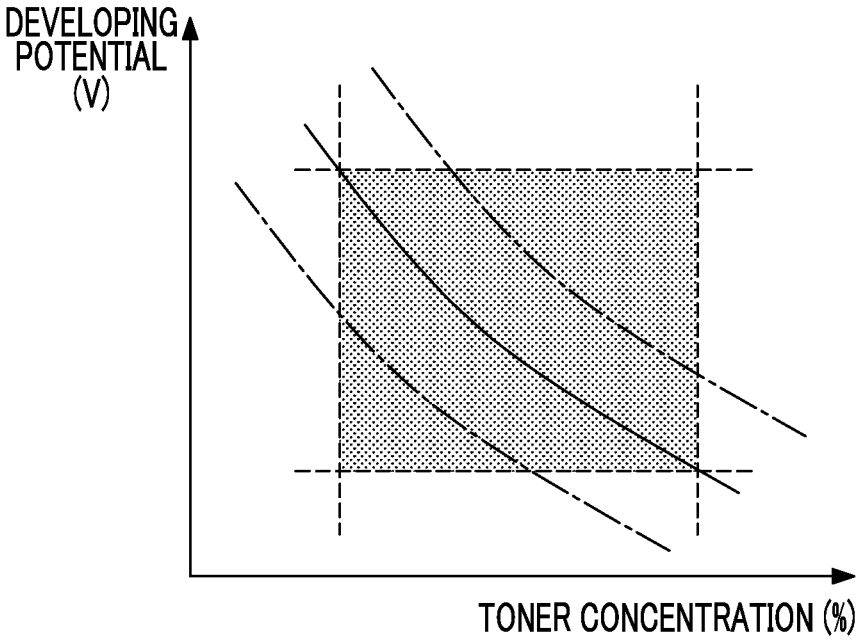
FIG. 4 is a diagram illustrating a relationship between toner concentration and a developing potential which relate to developability of the image forming apparatus.

In the image forming apparatus 12, image formation is controlled so as to cause a relationship between the toner concentration and the developing potential to be in a range of a hatching area which is surrounded by a dot line illustrated in FIG. 4. Various types of image defects occur in an area other than the hatching area illustrated in FIG. 4. Image formation is controlled with characteristics of ideal developability indicated by a solid line. For example, the target value of the toner concentration is changed, and thus the characteristics of the developability are shifted as indicated by one dot chain line. FIG. 4 is a diagram illustrating a relationship between the toner concentration (detection value of the toner concentration sensor 18) and the developing potential which relate to developability of each of the image forming apparatuses 12.

When charging characteristics of a toner is deteriorated, control for obtaining required density is focused on a lower left area of a curve (solid line in FIG. 4) indicating the ideal developability. Further, it may be determined that an incidence rate of a dot image (dot image which occurs by dropping an aggregated toner onto paper, and has no relationship with an image) as an image defect is increased, for example, when the developing potential is in the vicinity of a lower limit, and a state where the toner concentration which causes the toner to easily flow outwardly without developing (that is, causes toner clouds to occur) is higher than the ideal toner concentration continuously occurs and is accumulated.

When the developing potential which controls the developability is greater than a predetermined reference in a control state, the target value of the toner concentration is changed so as to be increased and thus the developability is ensured in the image forming apparatus 12. As a specific condition or a specific state, a case where the developing potential approaches the vicinity of an upper limit, a case where images having small pixel density are continuously formed, a case of a low humidity state in the environment, and the like are included.

When an image to be formed is changed to an image having large pixel density, and image formation is performed in a state where the toner concentration is increased as described above, replacement of the toner is rapidly performed in the developing device, the toner is insufficiently charged, and thus the charging characteristics are deteriorated. However, regarding a change speed of the charging characteristics due to the replacement, delay occurs in changing the toner concentration to the optimum target value of the toner concentration and a state where the toner concentration is higher than the ideal value occurs. When a state is rapidly changed from a low humidity state to a high humidity state, similarly, delay in control also occurs and the state where the toner concentration is higher than the ideal value also occurs. This state causes occurrence of a dot image which is an image defect.

Accordingly, in this exemplary embodiment, the developing potentials and the toner concentrations are employed as first characteristic values which have influence on the developability. The pixel densities, the humidities, the numbers of image-formed sheets, and the like are employed as second characteristic values which are different from the first characteristic values. The information collection unit 30 regularly collects information regarding these values. Thus, the image defect predictive diagnostic apparatus 14 predicts occurrence of a dot image as an image defect, based on information collected by the information collection unit 30. The second characteristic values are characteristic values which have influence on the developability and have less contribution degrees than those of the first characteristic values.

The information acquisition unit 40 acquires information relating to image formation and including the first characteristic values and the second characteristic values, from the image forming apparatus 12 regularly (for example, one time to four times per day). Also, the information acquisition unit 40 acquires the information relating to image formation and including the first characteristic values and the second characteristic values, when a fail associated with at least one of control of the developing potential and control of the toner concentration occurs. Particularly, in one example in which the information acquisition unit 40 acquires regularly, an average of the first characteristic values and an average of the second characteristic values are obtained for every 500 sheets, and the occurrence of the dot image is predicted based on frequencies of the averages of the first characteristic values and frequencies of the averages of the second characteristic values.

Here, a specific method of prediction of occurrence of a dot image, performed by the determination unit 58 will be described.

The prediction of occurrence of a dot image is determined by using the above-described information of the developing potential, the toner concentration, the pixel density, the humidity, the number of image-formed sheets, and the like.

Figure 5A:
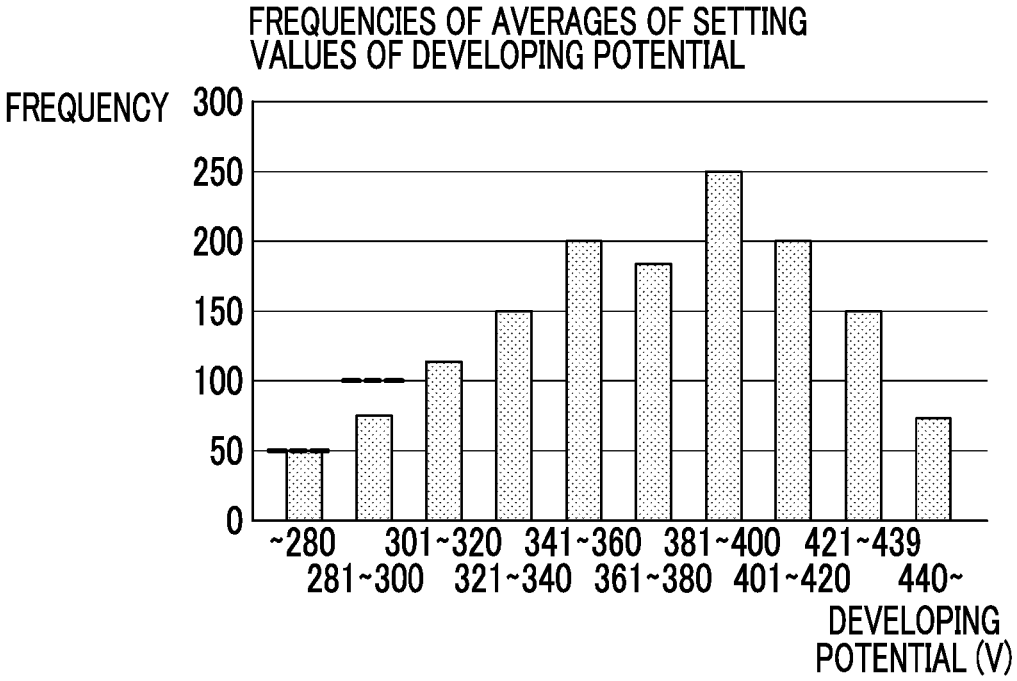
FIG. 5A is a diagram illustrating frequencies of averages of setting values of developing potential.

Specifically, a frequency of averages of setting values of the developing potential is obtained. When the obtained frequency is greater than a predetermined frequency threshold value, are the averages of the setting values of the developing potential employed as information (referred to as "determination information" below) for determining a possibility of occurrence of a dot image. For example, FIG. 5A illustrates that the frequency of the averages of setting values of developing potential which are equal to or less than 280 V reaches 50 which is set as a determination threshold value. Also, a determination threshold value for a frequency of the averages of the setting values of the developing potential in a range of 281 V to 300 V is set to 100. Thus, the obtained frequency is also employed as the determination information when the frequency of the averages of the setting values of the developing potential in the range of 281 V to 300 V is greater than this determination threshold value (that is, 100).

Figure 5B:
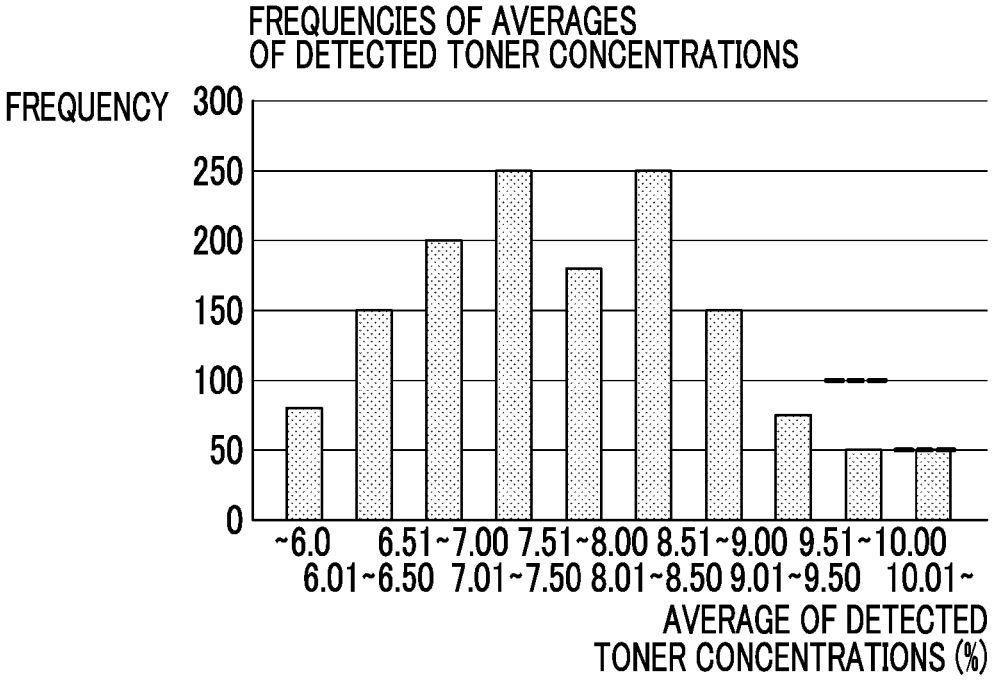
FIG. 5B is a diagram illustrating frequencies of averages of detected toner concentrations.

A frequency of averages of the detected toner concentrations is obtained. When the obtained frequency is greater than a predetermined frequency threshold value, the averages of the detected toner concentrations are employed as the determination information. For example, FIG. 5B illustrates that the frequency of the averages of the detected toner concentrations which are equal to or larger than 10.01% reaches 50 which is set as the determination threshold value. Also, a determination threshold value for a frequency of the averages of the detected toner concentrations in a range of 9.51% to 10.00% is set to 100. Thus, the obtained frequency is also employed as the determination information when the frequency of the averages of the detected toner concentrations in the range of 9.51% to 10.00% is greater than this determination threshold value (that is, 100).

Figure 6A:
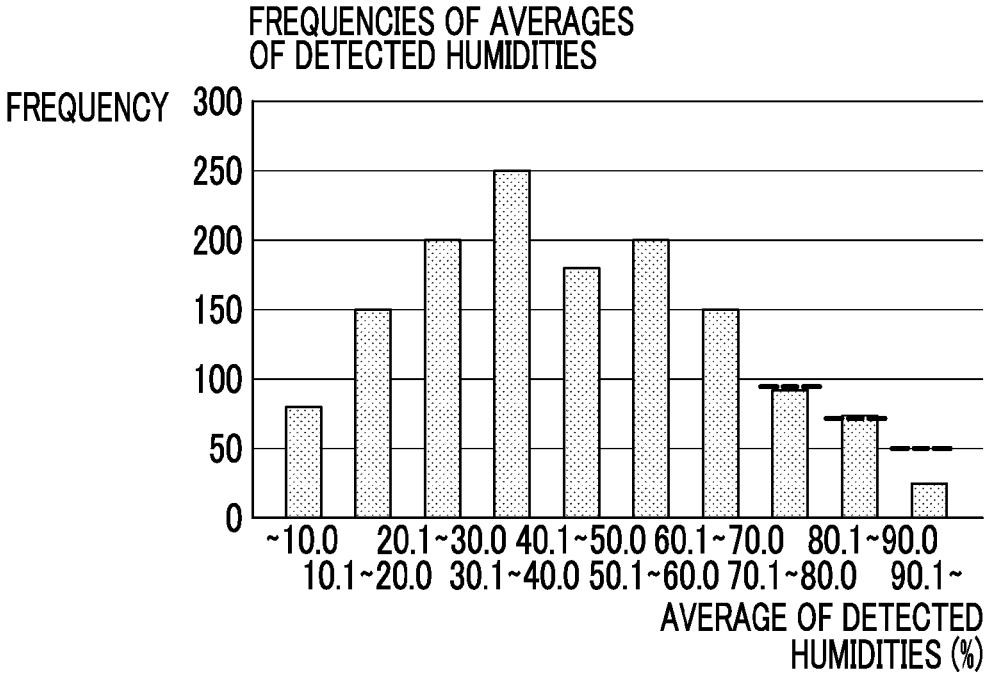
FIG. 6A is a diagram illustrating frequencies of averages of detected humidities.

A frequency of averages of detected humidities is obtained. When the obtained frequency is greater than a predetermined frequency threshold value, the averages of detected humidities are employed as the determination information. For example, FIG. 6A illustrates that the frequency of the averages of the detected humidities in a range of 80.1% to 90.0% reaches 75 which is set as a determination threshold value. Also, a determination threshold value for a frequency of the averages of the detected humidities in a range of 70.1% to 80.0% is set to 100. Furthermore, a determination threshold value for a frequency of the averages of the detected humidities which are greater than 90.1% is set to 50. Thus, the obtained frequency is also employed as the determination information when the frequency of the averages of the detected humidities in the range of 70.1% to 80.0% is greater than the determination threshold value (that is, 100) or when the frequency of the averages of the detected humidities which are greater than 90.1% is greater than the determination threshold value (that is, 50).

Figure 6B:
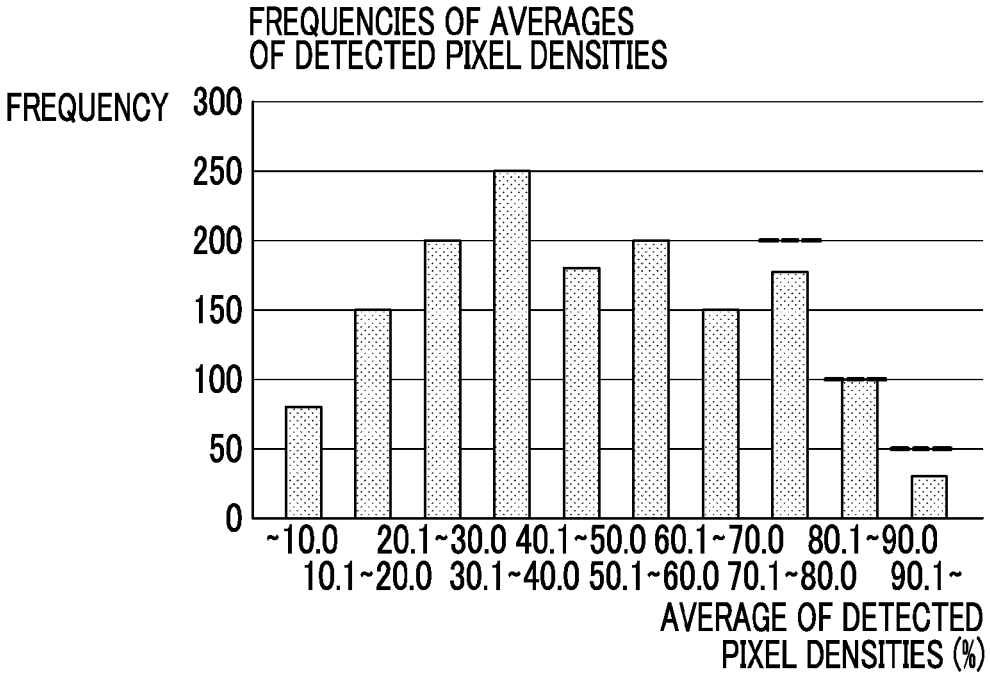
FIG. 6B is a diagram illustrating frequencies of averages of detected pixel densities.

A frequency of averages of detected pixel densities is obtained. When the obtained frequency is greater than a predetermined frequency threshold value, the averages of detected pixel densities are employed as the determination information. For example, FIG. 6B illustrates that the frequency of the averages of the detected pixel densities (%) in a range of 80.1% to 90.0% reaches 100 which is set as a determination threshold value. Also, a determination threshold value for a frequency of the averages of the detected pixel densities in a range of 70.1% to 80.0% is set to 200. Furthermore, a determination threshold value for a frequency of the averages of the detected pixel densities which are greater than 90.1% is set to 50. Thus, the obtained frequency is also employed as the determination information when the frequency of the averages of the detected pixel densities in the range of 70.1% to 80.0% is greater than the determination threshold value (that is, 200) or when the frequency of the averages of the detected pixel densities which are greater than 90.1% is greater than the determination threshold value (that is, 50).

Figure 6C:
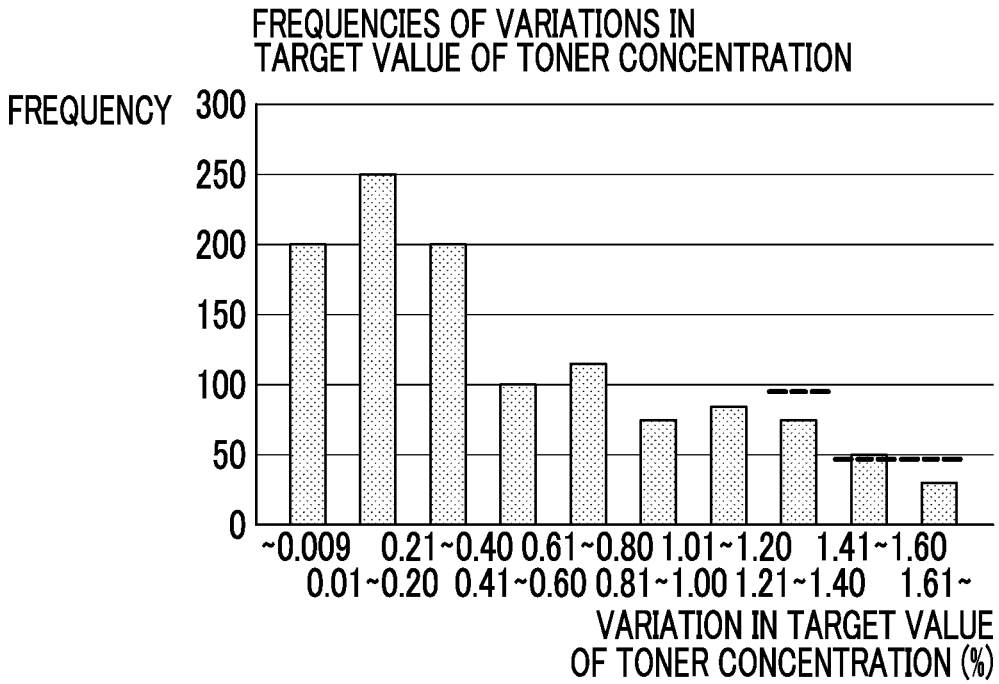
FIG. 6C is a diagram illustrating frequencies of variations in target value of toner concentration.

A frequency of variations in target value of a toner concentration is obtained. When the obtained frequency is greater than a predetermined frequency threshold value, the variations in target value of a toner concentration is employed as the determination information. For example, FIG. 6C illustrates that the frequency of the variations in the target value of the toner concentration (difference between a previous target value of the toner concentration and a current target value of the toner concentration when the current target value is obtained by increasing the target value of the toner concentration with respect to the previous target value) in a range of 1.41% to 1.60% reaches 50 which is set as a determination threshold value. Also, a determination threshold value for a frequency of the variations in the target value of the toner concentration in a range of 1.21% to 1.40% is set to 100. Furthermore, a determination threshold value for a frequency of the variations in the target value of the toner concentration which are greater than 1.61% is set to 50. Thus, the obtained frequency is also employed as the determination information when the frequency of the variations in the target value of the toner concentration in the range of 1.21% to 1.40% is greater than the determination threshold value (that is, 100) or when the frequency of the variations in the target value of the toner concentration which are greater than 1.61% is greater than the determination threshold value (that is, 50).

Figure 7A:
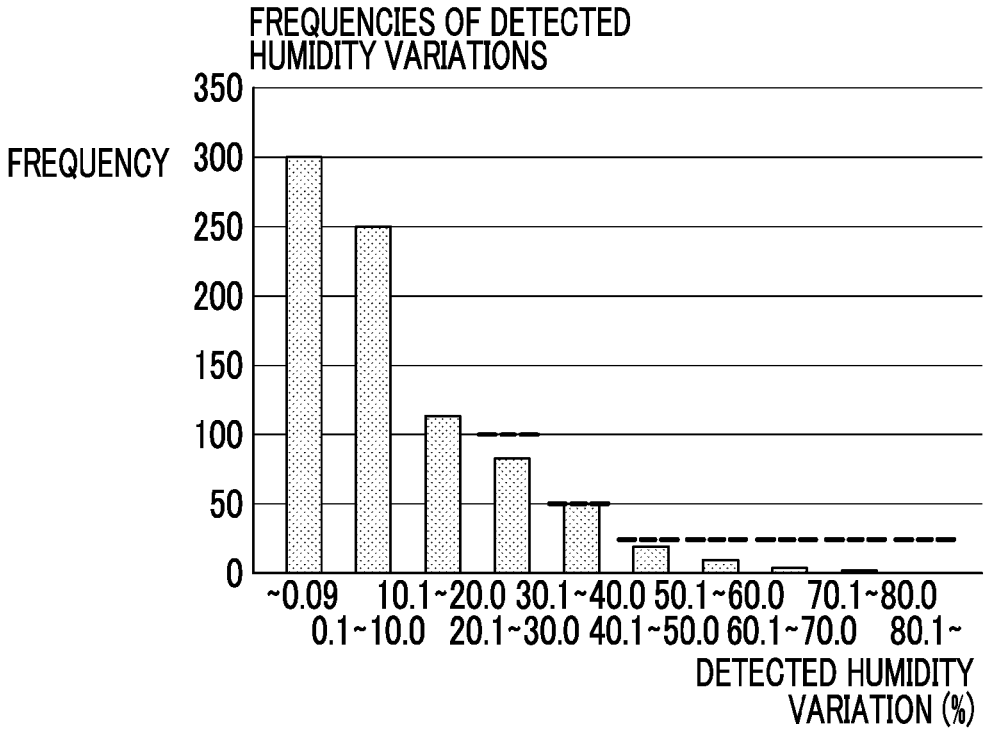
FIG. 7A is a diagram illustrating frequencies of detected humidity variations.

A frequency of detected humidity variations is obtained. When the obtained frequency is greater than a predetermined frequency threshold value, the detected humidity variations are employed as the determination information. For example, FIG. 7A illustrates that the frequency of the detected humidity variations (each of which is a difference between a previous detected humidity and a current detected humidity changed in the direction in which the humidity is increased) in a range of 30.1% to 40.0% reaches 50. Also, a threshold value for a frequency of the detected humidity variations in a range of 20.1% to 30.0% is set to 100. Furthermore, a threshold value for a frequency of the detected humidity variations which are equal to or greater than 40.1% is set to 25. Thus, the obtained frequency is also employed as the determination information when the frequency of the detected humidity variations in the range of 20.1% to 30.0% is greater than the threshold value (that is, 100) or when the frequency of the detected humidity variations which are equal to or greater than 40.1% is greater than the threshold value (that is, 25).

Figure 7B:
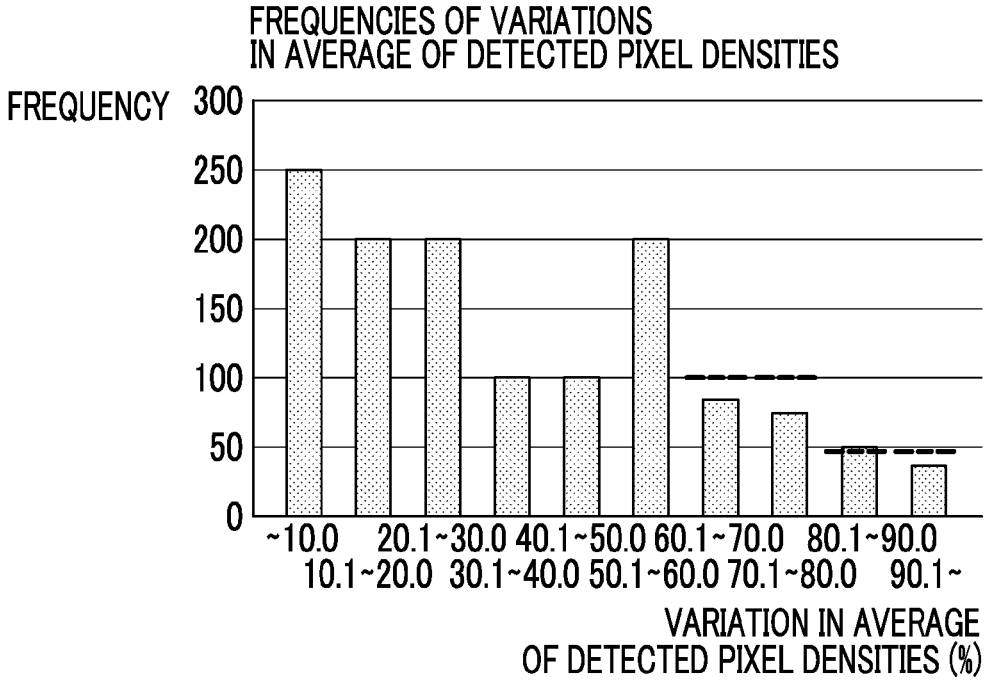
FIG. 7B is a diagram illustrating frequencies of variations in average of detected pixel densities.

A frequency of variations in average of detected pixel densities is obtained. When the obtained frequency is greater than a predetermined frequency threshold value, the variations in average of detected pixel densities are employed as the determination information. For example, FIG. 7B illustrates that the frequency of the variations in average of detected pixel densities (each of which is a difference between a previous average of detected pixel densities and a current average of detected pixel densities changed in the direction in which the average is increased) in a range of 80.1% to 90.0% reaches 50. Also, a threshold value for a frequency of the variations in average of detected pixel densities in a range of 60.1% to 70.0% or 70.1% to 80.0% is set to 100. Furthermore, a threshold value for a frequency of the variations in average of detected pixel densities which are equal to or greater than 90.1% is set to 50. Thus, the obtained frequency is also employed as the determination information when the frequency of the variations in average of detected pixel densities in the range of 60.1% to 70.0% or 70.1% to 80.0% is greater than the threshold value (that is, 100) or when the frequency of the variations in average of detected pixel densities which are equal to or greater than 90.1% is greater than the threshold value (that is, 50).

In this exemplary embodiment, of what exceed the respective threshold values and are employed as the determination information, the averages of the setting values of the developing potential and the averages of detected toner concentrations which are obtained from the first characteristic values influencing the developability are defined as a first determination factor. The averages of detected humidities, the averages of the detected pixel densities, the variations in target value of a toner concentration, the detected humidity variations, and the variations in average of detected pixel densities which are obtained from the second characteristic values are defined as a second determination factor.

When the frequency of at least one of the averages of the setting values of the developing potential and the averages of the detected toner concentrations which are the first determination factors is greater than the threshold value and thus the at least one of the averages of the setting values of the developing potential and the averages of the detected toner concentrations are employed as the determination information, an occurrence probability of a dot image is defined to be 50%. When any of the averages of the detected humidities, the averages of the detected pixel densities, the variations in target value of toner concentration, the detected humidity variations, and the variations in average of detected pixel densities which are the second determination factors are employed as the determination information, the occurrence probability of a dot image is defined to be 10%. If occurrence probabilities are added and a result of addition is equal to or greater than 70%, the target image forming apparatus 12 is notified that a dot image possibly appears. In addition, the image defect predicative diagnostic apparatus 14 controls the image forming apparatus 12 to cause a message indicating maintenance is required to be displayed in a display unit and the like.

In this exemplary embodiment, the occurrence probability of the dot image based on the first determination factor is defined to be 50%, and the occurrence probability based on the second determination factor is defined to be 10%, and a weight more than that of the second characteristic values is applied to the first characteristic values. These are obtained as a result of the inventors optimizing parameters, and vary depending on the size of the developing device, an accumulated quantity of a developer, the charging characteristics of the toner, and the like. For example, if at least one of the variations in target value of toner concentration and the variations in average of detected pixel densities contribute greatly to the occurrence probability, the occurrence probability may be increased up to 20%. The reason that the occurrence probabilities based on the first determination factor and the second determination factor are added, and notification that the result of addition is equal to or greater than 70% is performed is because prediction accuracy only by using the first determination factor is low and the prediction accuracy is improved by adding two or more second determination factors.

In this exemplary embodiment, at least one of the developing potentials and the toner concentrations are set as the first characteristic values. However, the toner concentrations may be handled as a factor which more directly causes a dot image (color spot) to occur. Thus, the toner concentrations may be set as the first characteristic values, and the developing potentials may be set as the second characteristic values.

Figure 8:
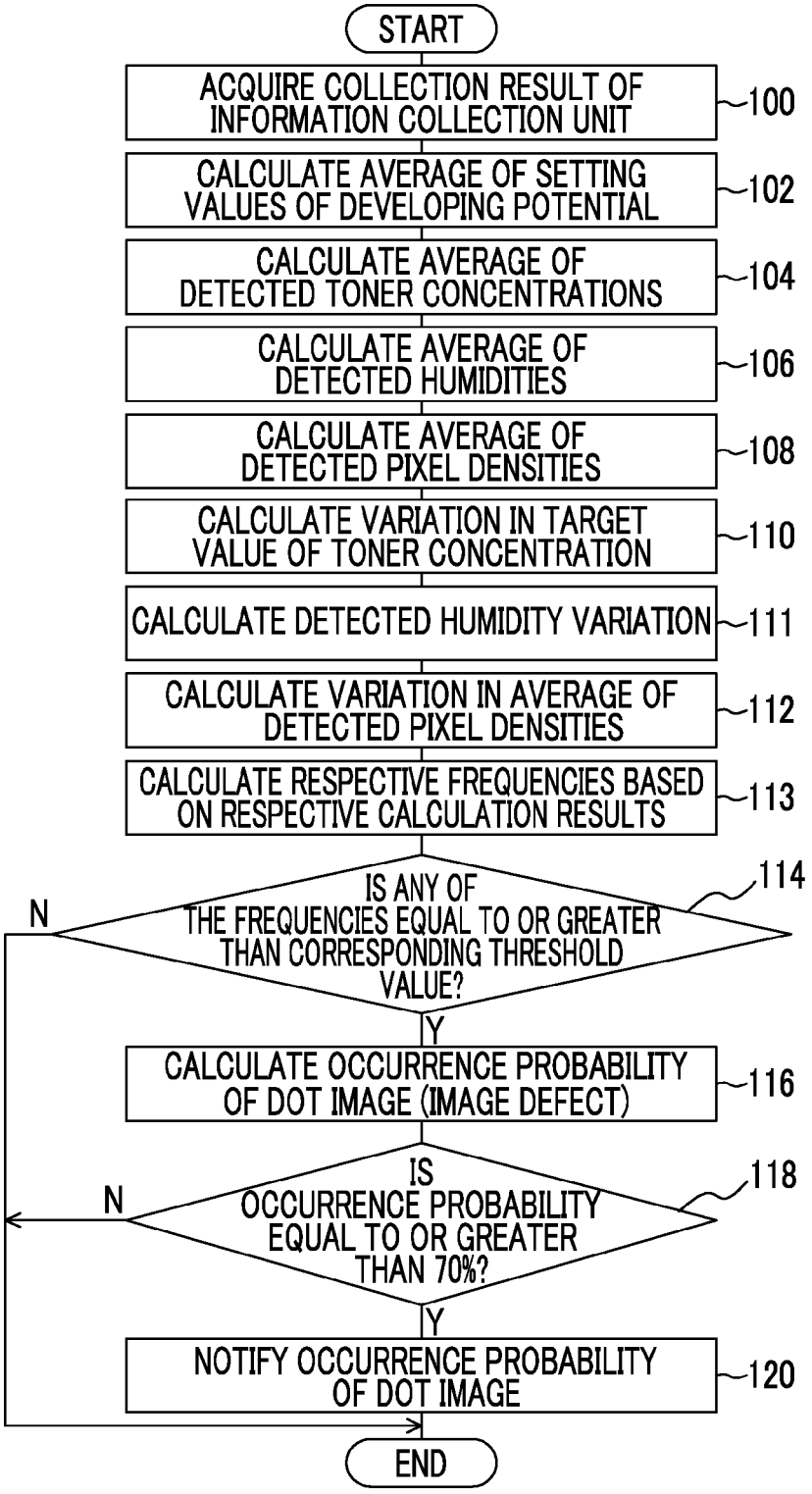
FIG. 8 is a flowchart illustrating an example of a flow of processes performed by the image defect predictive diagnostic apparatus according to this exemplary embodiment.

A specific flow of processes performed by the image defect predicative diagnostic apparatus 14 will be described. FIG. 8 is a flowchart illustrating an example of a flow of processes performed by the image defect predicative diagnostic apparatus 14 according to this exemplary embodiment. The processes in FIG. 8 are started when the information acquisition unit 40 regularly acquires information which includes the first characteristic values and the second characteristic values and is associated with image formation, from the image forming apparatus 12 one time to four times per day, and when a fail associated with control of the developing potential or the toner concentration occurs.

In Step 100, the information acquisition unit 40 acquires a collection result of the information collection unit 30 and then the process proceeds to Step 102. That is, the information acquisition unit 40 acquires information of the operation status, the use environment, and the like of the image forming apparatus 12. Specifically, the information acquisition unit 40 acquires detection results of the toner concentration sensor 18, the pixel counter 20, and the environmental sensor 34, and acquires information of the developing potential calculated by the developing potential calculation unit 28, the target value of the toner concentration calculated by the toner supply-quantity calculation unit 22, the number of image-formed sheets set by the setting unit, and the like.

In Step 102, the first calculation unit 42 calculates the average of the setting values of the developing potential, which are calculated by the developing potential calculation unit 28 and are set by the developing device 24, and then the process proceeds to Step 104.

In Step 104, the second calculation unit 44 calculates the average of the toner concentrations detected by the toner concentration sensor 18, and then the process proceeds to Step 106.

In Step 106, the third calculation unit 46 calculates the average of the humidities detected by the environmental sensor 34 and then the process proceeds to Step 108.

In Step 108, the fourth calculation unit 48 calculates the average of the pixel densities obtained from pixel count values which are obtained by counting of the pixel counter 20, and then the process proceeds to Step 110.

In Step 110, the fifth calculation unit 50 calculates the respective variations when the target value of the toner concentration is changed, based on information regarding the toner supply quantity calculated by the toner supply-quantity calculation unit 22. Then, the process proceeds to Step 111.

In Step 111, the sixth calculation unit 52 calculates the detected humidity variation based on the information of the humidity, which has been collected by the information collection unit 30. Then, the process proceeds to Step 112.

In Step 112, the seventh calculation unit 54 calculates a variation in average of detected pixel densities based on the pixel count values collected by the information collection unit 30. Then, the process proceeds to Step 113.

In Step 113, the frequency calculation unit 56 calculates the respective frequencies based on the calculation results obtained in Step 102 to Step 112. Then, the process proceeds to Step 114. For example, the frequency calculation unit 56 creates distribution of frequencies as illustrated in FIGS. 5A to 7B.

In Step 114, the determination unit 58 determines whether or not any of the obtained frequencies is equal to or greater than the corresponding frequency threshold value. When the determination is affirmed, the process proceeds to Step 116. When the determination is denied, the series of the processes is ended as it is.

In Step 116, the determination unit 58 calculates the occurrence probability of the dot image and then the process proceeds to Step 118. When information employed as the above-described determination information is the first determination factor, the occurrence probability of a dot image is calculated to be 50%. When this information is the second determination factor, the occurrence probability is calculated to be 10%. The occurrence probabilities based on the first determination factor and the second determination factor are added and thus the occurrence probability of the dot image is calculated.

In Step 118, the determination unit 58 determines whether or not the calculated occurrence probability of the dot image is equal to or greater than a predetermined probability (for example, 70% in this exemplary embodiment). When the determination is affirmed, the process proceeds to Step 120. When the determination is denied, the series of the processes is ended as it is.

In Step 120, the determination unit 58 notifies the target image forming apparatus 12 of the occurrence probability of the dot image through the communication network 16 and ends the series of the processes. That is, the determination unit 58 notifies the image forming apparatus 12 that a dot image possibly appears. Accordingly, a message indicating a dot image possibly appears is displayed on the image forming apparatus 12 side. In addition, a message indicating maintenance is required is displayed in the display unit and the like.

In the above exemplary embodiment, the image defect predicative diagnostic apparatus 14 calculates the averages of the setting values of the developing potential, the averages of the toner concentrations, the averages of the humidities, the averages of the pixel densities, the variations in target value of toner concentration, the detected humidity variations, and the variations in average of detected pixel densities. However, the invention is not limited thereto. For example, the image forming apparatus 12 may perform calculation and the image defect predicative diagnostic apparatus 14 may acquire results of the calculation as the information of the operation status or the use environment. In addition, the image forming apparatus 12 may calculate some of the above values to be calculated and the image defect predicative diagnostic apparatus 14 may calculate the remainder.

In the above exemplary embodiment, an example in which a computer is caused to execute an image forming program and thus the processes in FIG. 8 is performed is described. However, some or all of the processes executed by the image forming program may be performed by using hardware.

The processes performed by the image defect predicative diagnostic apparatus 14 according to the above exemplary embodiment may be stored in a recording medium in a program form and may be distributed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image defect predictive diagnostic apparatus comprising:

a processor programmed to acquire first characteristic values and second characteristic values from a plurality of information sources including one or more sensors in an image forming apparatus that forms an image by using an electrophotographic process, the first characteristic values including at least one of (i) toner concentrations and (ii) developing potentials, the first characteristic values having an influence on developability, the second characteristic values being different from the first characteristic values and including at least one of (i) pixel densities, (ii) humidities, and (iii) number of image-formed sheets;

predict the occurrence of a dot image which has no relationship with the image by applying a predetermined first occurrence probability in response to determining that a frequency of the first characteristic values is greater than a first determined threshold value, and applying a predetermined second occurrence probability in response to determining that a frequency of the second characteristic values is greater than a second determined threshold value, wherein the predetermined second occurrence probability is smaller than the predetermined first occurrence probability; and transmit a notification to the image forming apparatus indicating a likely occurrence of the dot image if a sum of the predetermined first occurrence probability and the predetermined second occurrence probability exceeds a threshold, such that a message indicating maintenance is required is displayed at the image forming apparatus.

2. The image defect predictive diagnostic apparatus according to claim 1, wherein the second characteristic values include at least one of (i) variations in pixel density and (ii) variations in humidity.

3. An image defect predictive diagnostic system comprising:

the image defect predictive diagnostic apparatus according to claim 1; and a plurality of image forming apparatuses that are connected to the image defect predictive diagnostic apparatus through a communication network, each image forming apparatus including a collection unit that collects the first characteristic values and the second characteristic values.

4. A non-transitory computer readable medium storing a program causing a computer to execute an image defect predictive diagnostic process, the process comprising:

acquiring first characteristic values and second characteristic values from a plurality of information sources including one or more sensors in an image forming apparatus that forms an image by using an electrophotographic process, the first characteristic values including at least one of (i) toner concentrations and (ii) developing potentials, the first characteristic values having an influence on developability, the second characteristic values being different from the first characteristic values and including at least one of (i) pixel densities, (ii) humidities, and (iii) number of image-formed sheets;

predicting the occurrence of a dot image which has no relationship with the image by applying a predetermined first occurrence probability in response to determining that a frequency of the first characteristic values is greater than a first determined threshold value, and applying a predetermined second occurrence probability in response to determining that a frequency of the second characteristic values is greater than a second determined threshold value, wherein the predetermined second occurrence probability is smaller than the predetermined first occurrence probability; and transmitting a notification to the image forming apparatus indicating a likely occurrence of the dot image if a sum of the predetermined first occurrence probability and the predetermined second occurrence probability exceeds a threshold, such that a message indicating maintenance is required is displayed at the image forming apparatus.

* * * * *